US006539698B2

(12) United States Patent
Fidan et al.

(10) Patent No.: US 6,539,698 B2
(45) Date of Patent: Apr. 1, 2003

(54) WRAPPED CORD

(75) Inventors: Mehmet Sadettin Fidan, Garbsen (DE); Gerhard Scharr, Elmenhorst (DE); Hanno Schombacher, Hannover (DE); Jens Kleffman, Hannover (DE)

(73) Assignee: Continental AG, Hanover (DE)

( * ) Notice: Subject to any disclaimer, the term of this patent is extended or adjusted under 35 U.S.C. 154(b) by 0 days.

(21) Appl. No.: 09/765,990

(22) Filed: Jan. 19, 2001

(65) Prior Publication Data

US 2002/0095928 A1 Jul. 25, 2002

(51) Int. Cl.[7] ..... D02G 03/36
(52) U.S. Cl. ..... 57/6; 57/3; 57/210; 57/243
(58) Field of Search ..... 152/451; 57/3, 57/6, 13, 200, 210, 229, 230, 237, 240, 243, 249

(56) References Cited

U.S. PATENT DOCUMENTS

| | | | |
|---|---|---|---|
| 3,634,972 | A | 1/1972 | Illman |
| 3,956,566 | A | 5/1976 | van Gils |
| 3,964,950 | A | 6/1976 | Boles |
| 3,968,304 | A | 7/1976 | Wise |
| 3,991,027 | A | 11/1976 | van Gils |
| 4,009,134 | A | 2/1977 | Elmer |
| 4,015,651 | A | 4/1977 | Witt |
| 4,026,744 | A | 5/1977 | Elmer |
| 4,134,869 | A | 1/1979 | Kalafus |
| 4,176,705 | A | 12/1979 | Russell |
| 4,251,409 | A | 2/1981 | Neubert |
| 4,281,409 | A | 7/1981 | Schneider |
| 4,409,055 | A | 10/1983 | Elmer |
| 5,215,613 | A | 6/1993 | Shemenski |
| 6,065,518 | A | 5/2000 | Miyawaki |
| 6,102,823 | A | 8/2000 | Hosokawa |

OTHER PUBLICATIONS

Pages from engineering handbook submitted by Examiner for reference in United States Patent and Trademark Office Action dated Apr. 24, 2002, in U.S. patent application No. 09/766,248 filed Jan. 19, 2001, to *Engineered Materials Handbook, vol. 2: Engineering Plastics* by SPI, Michael L. Bemans (ISBN 0–442–31799–9).

*Primary Examiner*—John J. Calvert
*Assistant Examiner*—Shaun R. Hurley
(74) *Attorney, Agent, or Firm*—John S. Child, Jr.

(57) ABSTRACT

The present invention relates to a wrapped cord comprising a bundle of inorganic filaments, to a method of making said wrapped cord, to a method of treating said wrapped cord with an adhesive treatment composition, to the treated wrapped cord obtainable by said method as well as to a reinforced rubber article comprising said treated cord, such as automotive tires.

42 Claims, 2 Drawing Sheets

WRAPPED CORD

The present invention relates to a wrapped cord comprising a core bundle of inorganic filaments, to a method of making said wrapped cord, to a method of treating said wrapped cord with a treatment composition and to the treated wrapped cord obtainable by said method as well as to a reinforced rubber article comprising said treated cord, such as automotive tires.

BACKGROUND OF THE INVENTION

A tire is a highly engineered composite designed to provide safety and durability. Tires, in particular automotive tires for passenger cars or aircraft tires for aircrafts, undergo significant dynamic and static stresses and strains in the course of ordinary service life. Performance is critical in this product application due to ramifications of failure while in use. In order to obtain the necessary performance characteristics critical to the proper functioning of a tire, structural reinforcement is a required component of the tire composite. This reinforcement provides many functions in a tire application, in particular overall strength, dimensional stability for the tire and a mechanism to handle stress dissipation during operation (fatigue), Currently, there is a well established set of products/processes to provide the reinforcing material used in passenger and truck tire applications.

1. High strength and ultra high modulus reinforcement materials like steel cord are used as belt in passenger and truck tires and as carcass in truck tires.
2. The steel cords contain steel filaments which are twisted to form a helix structured cord. The helix structure gives the cord bending flexibility and compressibility.
3. Each individual filament in steel cord is coated with brass layer. The brass layer gives a good adhesion between steel and rubber matrix. The adhesion is needed for stress transfer between cord and rubber matrix.
4. After a calendering process in which the steel cords are embedded in rubber, the rubberized cord layers can be introduced to the tire manufacturing process.

The step(s) that involve(s) twisting and plying is a critical operation in this series of processes. In this step, the proper construction and amount of twist must be established in order to obtain the proper fatigue resistance; however, this must be balanced against the loss in strength and modulus that occurs with twisting/plying as well as the costs for imparting twist, which increase with increasing twist levels. Much effort has been put into developing the proper twist levels to minimize cost and meet key durability requirements.

It has been shown that the twist imparted to the cord structure allows the cord to uniformly dissipate strain during compressive forces, the predominant forces (with respect to fatigue failure) that occur in service. The twist allows the cord to move out of plane during compression, thus avoiding catastrophic failure.

However, the conventional twisted cords suffer from modulus and breaking strength losses due to their helical constructions while having improved flex and compression fatigue resistance. The losses increase with increasing twist-level or helix-angle.

SUMMARY OF THE INVENTION

It has been an object of the present invention to provide a mechanism for strain dissipation and therefore fatigue resistance that does not require the conventional state-of-the-art twisting/cabling operations. In particular it has been an object of the present invention to provide a cord that combines the original yarn properties (a high breaking strength and, preferably, a high modulus) with an improved fatigue resistance.

Additionally, it has been an object of the present invention to provide a method for making said improved cord.

A further object of the present invention was to provide a such improved cord being treated with a treatment agent that promotes adhesion (adhesive agent) to rubber and said treated cord being ready to be introduced into the true manufacturing process where it is combined with rubber. Finally it has been an object of the present invention to provide a reinforced rubber article comprising the treated cord of the invention in the form of said cord itself or a fabric comprising said cord as a reinforcement.

It has been found that the above and further objects can be achieved by wrapping a low-denier, high shrinkage organic fiber (yarn) around a core bundle of inorganic filaments (yarns) resulting in a cord that resists fatigue while maintaining bundle coherency. The cord of the invention provides a mechanism for strain dissipation and therefore fatigue resistance, that does not require the twisting/cabling operations. The wrap material is wrapped in a helical pattern around the core, where wrap frequency and wrap angle can be specified based on performance requirements.

This cord structure according to the present invention has advantages over the conventional cord that is twisted and plied in that the elimination of twisting/cabling operations saves costs and, because the inorganic core ultra high modulus fiber is not twisted, there is no strength-loss of the core bundle in the cord. This allows fabric constructions to be modified to utilize less material to achieve the same strength and therefore reduces cost. Additionally, compared to conventional metal cords which are used in certain applications the cords according to the present invention help to reduce the weight of the reinforced article. In summary, the wrapped cord according to the present invention provides a cost-reduction for the formation of tire cord reinforcement and increased modulus while maintaining the necessary performance characteristics.

DETAILED DESCRIPTION OF THE INVENTION

Figure 1:
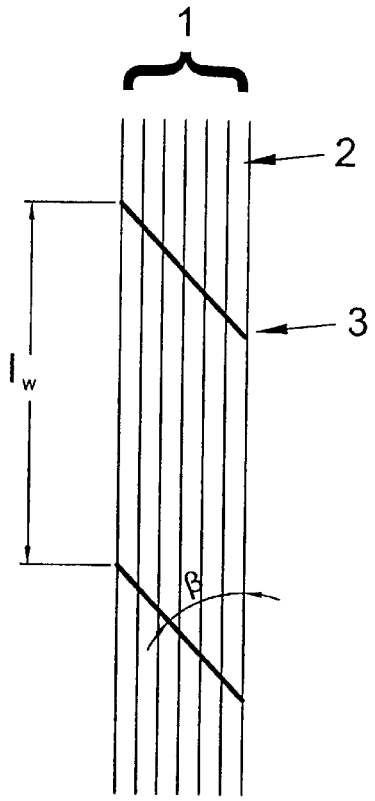
FIG. 1 shows a wrapped cord 1 according to the invention comprising a core bundle of inorganic filaments 2 and a shrinkable wrap 3 wrapped around the core bundle of inorganic filaments 2 and wherein "$I_w$" represents the inter-wrap distance ($I_w$=1/wpm; "wpm"=wraps per meter) and "β" the wrap-angle, i.e., the angle between the bundle-axis and the wrap.
Figure 2:
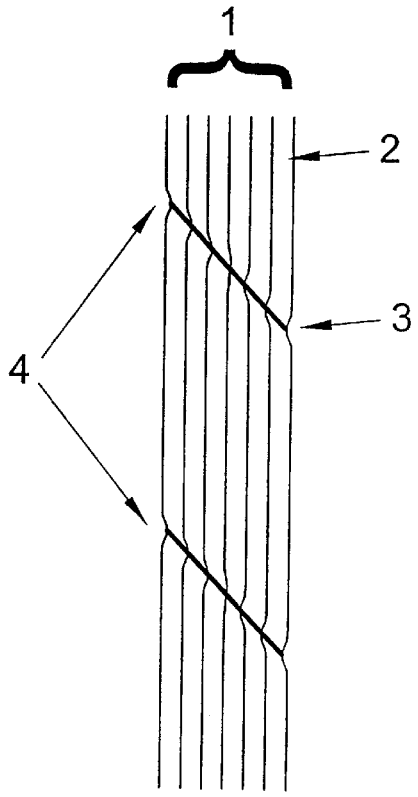
FIG. 2 shows a wrapped cord 1 according to the invention comprising a core bundle of inorganic filaments 2 and a shrunk wrap 3 wrapped around the core bundle of inorganic filaments 2 wherein the indentations 4 are formed due to the shrunk wrap (wrap-induced indentations).
Figure 3:
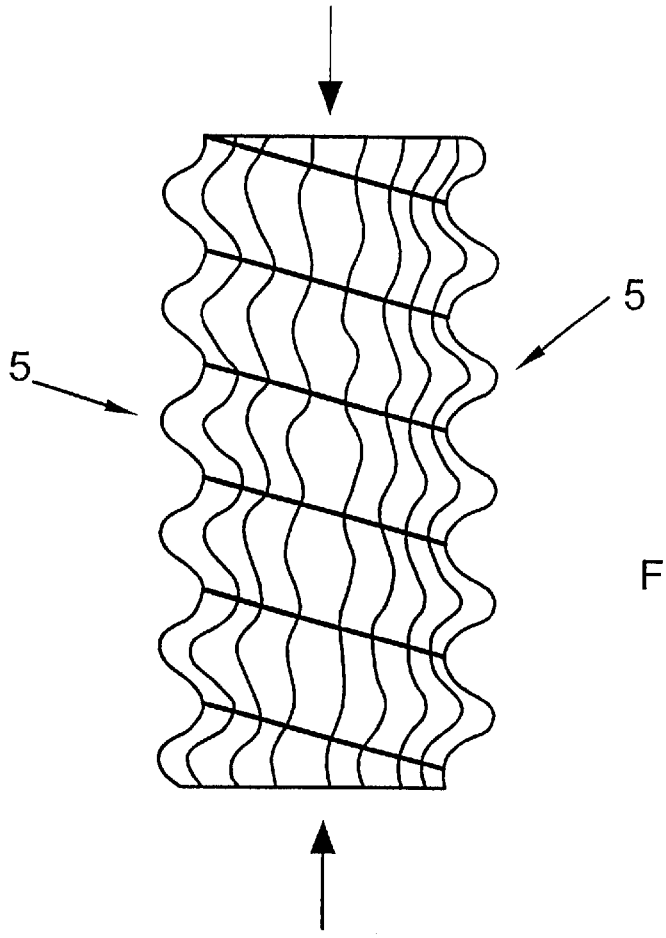
FIG. 3 shows the wrapped cord 1 according to the invention under compression wherein buckles 5 are formed between the wrap.
Figure 4:
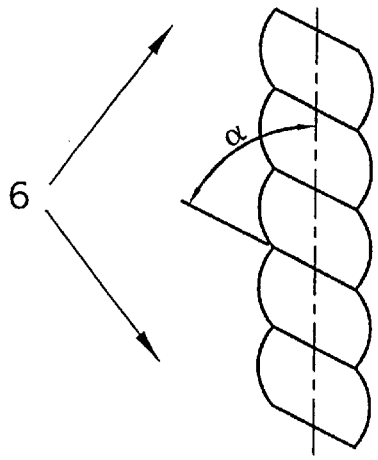
FIG. 4 shows a conventional, state-of-the-art twisted cord comprising yarn plies 6 being twisted at a helix-angle "α"

In conjunction with the present invention the meaning of the following terms is defined as follows:

A filament is a continuous fiber usually made by extrusion from a spinneret and which can be converted into a yarn.

A yarn is represented by a number of fibers twisted together or laid together without a twist (zero-twist yarn).

A cord is the product formed by twisting together two or more plied yarns.

The present invention relates to a wrapped cord comprising as its core a bundle of inorganic filaments and a wrap helically wound around the bundle of inorganic filaments wherein the wrap material has a free shrinkage in hot air at 100° C. of from about 10% to about 60%.

The free shrinkage (without pretension) of the wrap material is essential in order to have an effective squeezing effect on the core bundle of inorganic filaments upon shrinkage.

The filaments of the core material are made of an inorganic material selected from carbon, glass and alumina. In general, the tensile modulus of the inorganic core filaments can range from low to high moduli and is from about 50 to about 1,000 GPa (kN/mm$^2$) (measured according to ISO/FDIS 10618), in another embodiment said modulus is from about 100 to about 750 GPa. The inorganic core filaments have no thermal shrinkability.

In general the tensile strength of the inorganic filaments making up the core bundle is from about 1,000 to about 10,000 MPa (measured according to ISO/FDIS 10618), in another embodiment from about 2,000 to about 7,000 MPa and in a still further embodiment from about 3,000 to about 5,000 MPa.

Specifically, the modulus of the carbon filaments is from about 200 to about 750 GPa, in another embodiment said modulus is from about 250 to about 500 GPa. The tensile strength of the carbon filaments making up the core bundle of inorganic filaments is from about 2000 to about 7000 MPa, in another embodiment from about 3000 to about 6000 MPa and in a still further embodiment from about 4000 to about 5000 MPa.

Specifically, the modulus of the glass filaments is from about 50 to about 90 GPa, in another embodiment said modulus is from about 70 to about 80 GPa. The tensile strength of the glass filaments making up the core bundle of inorganic filaments is from about 2000 to about 5000 MPa, in another embodiment from about 2500 to about 4500 MPa and in a still further embodiment from about 3000 to about 4000 MPa.

Specifically, the modulus of the alumina filaments is from about 150 to about 500 GPa, in another embodiment said modulus is from about 200 to about 400 GPa. The tensile strength of the alumina filaments making up the core bundle of inorganic filaments is from about 1500 to about 2500 MPa, in another embodiment from about 1600 to about 2200 MPa and in a still further embodiment from about 1700 to about 2000 MPa.

The dtex of the individual core filaments is from about 1.0 to about 50 dtex (measured according to ASTM D885 M), in another embodiment from about 5 to about 20 dtex and in a still further embodiment from about 5 to about 10 dtex.

The core bundle of the wrapped cord according to the invention comprises from about 1,000 to about 50,000, in another embodiment from about 3,000 to about 30,000 and in a still further embodiment from about 5,000 to about 25,000 filaments of said inorganic material. The core bundle of inorganic filaments has a twist level from 0.0 to 100 tpm in Z direction for a 8,000 dtex carbon fiber (12000 filaments). The upper twist level for different dtex and material types (mat.) can be calculated on the basis of the following formula:

$$tpm_{(mat.)}=[(100\times\sqrt{8{,}000}/\sqrt{dtex_{(mat.)}})\times(\sqrt{\rho_{(mat.)}}/\sqrt{\rho_{CF}})]$$

wherein tpm represents turns per meter, dtex is total bundle dtex, and ρ represents the specific density of the filament polymer ($\rho_{CF}$: 1.80 g/cm$^3$; CF=carbon fiber).

In another embodiment the number of twists per meter of bundle, is from about 20 to about 40. Due to their untwisted or low twisted bundle they give the reinforcement high breaking-strength and modulus.

In general any inorganic material known as having a utility as reinforcing fiber and having the above described physical properties is suitable as the inorganic material of the core filaments. Suitable materials for these filaments are selected from the group consisting of carbon, glass and alumina.

One of the most commonly used inorganic fibers is carbon fibers. They are characterized by high modulus, high strength, low density and a negative coefficient of thermal expansion along the fiber direction. High modulus carbon fibers are prepared primarily from PAN (polyacrylonitrile). To produce carbon fibers, PAN is spun into fiber form by melt or solution spinning. The spun fibers are stretched at about 100 to 150° C. to achieve an oriented structure. The oxidation is carried out in air between 200 to 250° C. During this process cyclization and dehydrogenation occurs. The next step is the carbonization. It is carried out by a sequence of thermal treatments from about 300° C. to about 1,500° C. in an inert atmosphere. The final step in the production of PAN-based fibers is graphitization which takes place under tension at temperatures in the range of from about 1,500 to 2,800° C.

Typical carbon materials are selected from the group consisting of M30 (Toray), Panex 33 (Zoltek) and MTA5131 Tenax fibers.

Typical glass materials are selected from the group consisting of E-Glass (Owens-Corning).

Typical alumina core filaments are commercially available, such as T-5760C from Nitivy Co. Ltd., Japan.

Inorganic filaments and methods of making these are conventional and well-known in the art.

The filament(s) of the wrap have/has a hot air shrinkability at 100° C. (shrinkage without pretension) of from about 10 to about 60%, in another embodiment from about 20 to about 40%, and in a still further embodiment from about 25 to about 35%.

The filament(s) of the wrap has/have a modulus of from about 20.0 to about 150.0 cN/dtex (as measured according to ASTM D885M), in another embodiment from about 30.0 to about 100.0 cN/dtex and in a still further embodiment from about 30.0 to 50.0 cN/dtex. Typically, the tenacity of said filament is from about 2.0 to about 12.0 cN/dtex, or from about 4.0 to about 8.0 cN/dtex or, in an alternative embodiment, from about 5.0 to 7.0 cN/dtex.

The wrap frequency (the number of wrap turns per meter of core bundle) of the wrap is from about 50 to 250 for a 8,000 dtex core yarn, preferably between 60 and 200 and most preferably between 70 and 150 (in S direction).

The corresponding wrap ranges for other dtex's and material types can be calculated from the following formula:

$$WPM_{mat.}=[(WPM_{CF}\times\sqrt{8{,}000}/\sqrt{dtex_{mat.}})\times(\sqrt{\rho_{mat.}}/\sqrt{1.8})]$$

Wherein WPM means wrap per meter, $WPM_{CF}$ means reference WPM for carbon fiber (CF), $\rho_{mat.}$=specific density of new material and $dtex_{mat.}$ corresponds to the total bundle dtex of new material.

Any organic material having the above-described physical properties is suitable as the material of the wrap filaments or yarn. Suitable materials are selected from the group consisting of polyesters, such as aliphatic and aromatic polyesters, and aliphatic polyamides. In one embodiment the polyesters are selected from polyethyleneterephthalate, polyethylenenaphthalate, polyethylenebibenzoate, polytriethyleneterephthalate, polytrimethylenenaphthalate, polytrimethylenebibenzoate, polybutyleneterephthalate, polybutylenenaphthalate and polybutylenebibenzoate or polyesters made from mixtures of the individual monomers.

Typical polyamides are selected from the group consisting of linear aliphatic polyamides, such as PA 6, PA 6.6 and PA 4.6.

The fibers (filaments) with high amorph orientation are high shrinkage materials. Typical materials are available under the tradename "wire" (shrinkable yarn) from Wire & Rapos, U.S. (Ozeki Co., Japan).

General background information about the filaments mentioned above, their manufacture and properties can be found, for instance, in "Synthetische Fasern: Herstellung, Maschinen und Apparate, Eigenschaften; Hand-buch für Anlagenplanung, Maschinenkonstruktionen und Betrieb" by F. Fourne, Carl Hanser Verlag, Germany, 1995.

The wrap dtex is from 3 to 40% of core-yarn dtex, preferably 5 to 30%, most preferably 10 to 20%.

In a more specific embodiment the present invention relates to a wrapped cord comprising the above-described core-bundle of inorganic filaments and the wrap wherein the wrap is shrunk onto the core-bundle of said inorganic filaments. In one embodiment the shrinkage of the wrap is effected by heat-treating the wrapped cord described below. Due to the shrinkage of the wrap, the indentations are formed in the core bundle. Under compression these indentations generate micro-buckles between the wraps which improves the fatigue-resistance. This leads to a uniform distribution of axial or bending compression.

The wrapped cord described above and comprising the heat-shrunk wrap can be made by forming the bundle of the inorganic core filaments, wrapping the wrap around said core bundle of inorganic filaments wherein the wrap material has a free shrinkage at 100° C. in hot air of from about 10% to 60% and exposing said wrapped cord to an elevated temperature for a time sufficient to shrink the wrap onto the core bundle resulting in the wrapped cord according to the present invention in which the wrap is shrunk onto the core bundle.

Typically, in order to effect the heat-shrinkage of the wrap on the core bundle of inorganic filaments the wrapped cord is exposed to a temperature of from about 110° C. to 220° C., alternatively from about 170° C. to about 190° C. The exposure-time may vary from about 1 minute and 5 minutes or, alternatively, between about 2 and 4 minutes, depending on the wrap-material to be shrunk and the temperature employed.

Methods and devices (wrapping machines) for wrapping a core bundle of filaments with a filament or yarn are conventional and known in the art. Likewise, methods for the heat-treatment of untreated or treated yarns and cords are well known in the art.

Prior to the incorporation of the wrapped cord of the present invention into rubber as a reinforcement, the cord must be treated to impart an acceptable level of adhesion to the rubber which is necessary for composite performance.

Thus, the wrapped cord according to the present invention is treated with an aqueous agent, i.e., an aqueous dip comprising an adhesive composition. Subsequently said wrapped cord is dried, cured and heat-set.

As the fatigue resistance of the filament bundle is bending stiffness dependent a low pick-up of the adhesive composition is necessary. In one embodiment the treated cord according to the invention comprises, after drying the cord, from about 0.1 to about 10% by weight of the adhesive composition, based on the total weight of the treated wrapped cord. In another embodiment the treated dried cord comprises 0.2 to 5% by weight, in a yet other embodiment 0.5 to 3.0% by weight, based on the total weight of the treated and dried wrapped cord.

The dip pick-up (DPU) can be calculated based on the weight as follows:

$$DPU(\%)=[(\text{treated}-\text{greige})/(\text{greige})]\times 100.$$

In conjunction with the shrunk wrapped cord according to the present invention this low dip pick-up provides for an acceptable balance of level of adhesion, high breaking-strength, fatigue-resistance and low bending stiffness (flexibility).

Generally, any dip known in the art for improving and/or imparting adhesion of organic filaments, such as polyester and polyamide filaments to rubbers when forming cord-reinforced rubber composites can be utilized such as those disclosed in U.S. Pat. Nos. 3,956,566; 3,964,950; 3,968,304; 3,991,027; 4,009,134; 4,026,744; 4,134,869; 4,251,409 and 4,409,055 the entire disclosure of which is incorporated herein by reference. Known in the art examples for adhesive dips are RFL-based dips such as D5 for nylon and D20 for polyester which are commercially available under these designations from General Tire Corp., USA.

In one embodiment the adhesive composition is a mixture of resorcinol/formaldehyde resin and and elastomeric (rubber) latex, such as vinylpyridine butadiene styrene latex. This mixture is applied to the wrapped cord in the form of an aqueous dip comprising said adhesive composition. These dips are known in the art as "RFL"-dips. They are an aqueous mixture of a precondensate obtained by the reaction of resorcinol and formalin in the presence of an acidic or alkaline catalyst and one or more latexes selected from styrene-butadiene copolymer latex, carboxyl group containing styrene-butadiene copolymer latex, styrene-butadiene-vinylpyridine terpolymer latex, acrylonitrile-butadiene copolymer latex, polychloroprene latex, polybutadiene latex, natural rubber latex, and the like. The solids content of said RLF-dips ranges from about 1.0% to about 20%, alternatively from about 1.0% to about 5.0% by weight, based on the aqueous dip composition. Methods and devices for applying liquid treatment agents to fibers and yarns are known in the art.

Suitable RFL-dips which can be used in conjunction with the cords according to the present invention are known in the art. A typical RFL-dip, for example for PET, is represented by the following formulation:

| | |
|---|---|
| Water | 519.8 g |
| VP-Latex (40%) | 416.7 g |
| RF-Resin (75%) | 39.9 g |
| Ammonia (25%) | 11.2 g |
| Formaldehyde (37%) | 12.4 g |
| Total | 1000.0 g (20% solids content) |

The solids content can be reduced by diluting with water in order to provide fr a low DPU on the wrapped cord.

The method for making the treated wrapped cords of the present invention comprises the steps of (a) forming a core bundle of inorganic filaments;

(b) wrapping a wrap around said core bundle of inorganic filaments, wherein the wrap material has a free shrinkage in hot air at 100° C. of from 10% to about 60%;

(c) exposing said wrapped cord to an elevated temperature to shrink the wrap;

(d) treating said wrapped cord with an aqueous agent comprising an adhesive composition; and (e) drying, curing and heat-setting said treated wrapped cord.

The shrinkage step (c) is carried out at a temperature of from about 110 to 220° C., in alternative embodiments as described above. The drying step (e) is carried out at a temperature of 110 to 160° C., curing of the adhesive composition and heat-setting is carried out at a temperature of 150 to 220° C., preferably 170 to 210° C., most preferably 180 to 200° C.

In an alternative method for making the treated wrapped cord according to the present invention the method comprises the steps of (a) forming a core bundle of inorganic filaments;

(b) wrapping a wrap around said core bundle of inorganic filaments wherein the wrap material has a free shrinkage in hot air at 100° C. of from about 10% to about 60%;

(c) treating said wrapped cord with an aqueous agent comprising an adhesive composition; and (d) exposing said treated wrapped cord to an elevated temperature to effect shrinkage of the wrap, drying and curing of the adhesive.

Typically, shrinking of the wrap is carried out at temperatures as defined above and drying the cord is carried out at a temperature of about 110 to about 160° C. Adhesive curing and heat-setting is subsequently carried out at a temperature of about 150 to about 220° C.

The wrapped cord according to the invention finds utility in reinforcing rubber articles which comprise the treated wrapped cord according to the invention completely or partially embedded in rubber. Typical such cord-rubber composites are selected from the group consisting of tires, carcasses, belts and hoses.

Typical rubbers into which the treated wrapped cord according to the invention is embedded are selected from those known in the art for reinforcements.

What is claimed is:

1. As wrapped cord comprising a core bundle of inorganic filaments of a wrap material having a free shrinkage in hot air at 100° C. of from about 10% to 60% wrapped around said core bundle and shrunk by exposing the wrapped cord to an elevated temperature resulting in the formation of micro-buckles in the wrap material.

2. The wrapped cord of claim 1 wherein the inorganic core filaments have a modulus of about 50 to about 1,000 MPa (ISO/FDIS 10618).

3. The wrapped cord of claim 1 wherein the inorganic core filaments have a tensile strength of about 1,000 to about 10,000 MPa (ISO/FDIS 10618).

4. The wrapped cord of claim 1 wherein the inorganic core filaments have a dtex of about 1.0 to about 50 dtex (ASTM D 885 M).

5. The wrapped cord of claim 1 wherein the core bundle of filaments comprises about 1000 to about 50,000 filaments.

6. The wrapped cord of claim 1 wherein the inorganic core filaments are made of an inorganic material selected from carbon, glass and alumina.

7. The wrapped cord of claim 6 wherein the inorganic core filaments are made of carbon fibers.

8. The wrapped cord of claim 1 wherein the wrap comprises a single filament or a yarn of filaments.

9. The wrapped cord of claim 8 wherein the wrap dtex is from 3 to 40% of the dtex of the inorganic core yarn dtex.

10. The wrapped cord of claim 1 wherein the wrap filaments have a thermal free shrinkability of about 20 to about 60% in hot air at 100° C.

11. The wrapped cord of claim 1 wherein the material of the wrap is selected from aliphatic polyesters, aromatic polyesters and aliphatic polyamides.

12. The wrapped cord of claim 11 wherein the polyester is selected from the group consisting of polyethyleneterephthalate, polyethylenenaphthalate, polyethylenebibenzoate, polytriethyleneterephthalate, polytrimethylenenaphthalate, polytrimethylenebibenzoate, poly-butyleneterephthalate, polybutylenenaphthalate and polybutylene-bibenzoate or polyesters made from mixtures of the individual monomers.

13. The wrapped cord of claim 11 wherein the polyamide is selected from the group consisting of PA 6, PA 6.6 and PA 4.6.

14. The wrapped cord of claim 1 wherein the filaments of the wrap have the following further properties:

a modulus of about 20 to about 150 cN dtex (ASTM D885M) and a tenacity of about 2.0 to about 12.0 cN/dtex (ASTM D885M).

15. The wrapped cord of claim 1 wherein the wrap is helically twisted around the core bundle of inorganic filaments.

16. A wrapped cord comprising a core bundle of inorganic filaments having no thermal shrinkability and a wrap wrapped around said core bundle of inorganic filaments, wherein the wrap material has a free shrinkage in hot air at 100° C. of from about 10% to about 60% and wherein the wrap is shrunk on the core bundle of inorganic filaments.

17. A method of making a wrapped cord comprising the steps of:

(a) forming a core bundle of inorganic filaments;

(b) wrapping a wrap around the core bundle of inorganic filaments, wherein the wrap material has a free shrinkage in hot air at 100° C. of from about 10% to about 60%;

(c) exposing the wrapped cord to an elevated temperature to effect the shrinkage of the wrap material.

18. The method of claim 17 wherein in step (c) the wrapped cord is exposed to a temperature of from about 110° C. to about 220° C.

19. A method of making a wrapped cord comprising the steps of:

(a) forming a core bundle of inorganic filaments;

(b) wrapping a wrap around the core bundle of inorganic filaments, wherein the wrap material has a free shrinkage in hot air at 100° C. of from about 10% to about 60%; and (c) exposing the wrapped cord to an elevated temperature for about 1 to about 5 minutes to effect the shrinkage of the wrap material.

20. The wrapped cord according to claim 1 wherein the core bundle comprises inorganic filaments and a wrap is helically wound around the bundle of inorganic filaments.

21. The wrapped cord according to claim 20 wherein the core bundle comprises inorganic filaments and a wrap is helically wound around the bundle of inorganic filaments wherein the number of wrap turns per meter of core bundle is from about 50 to 250 for a 8000 dtex core bundle.

22. The wrapped cord according to claim 21 wherein the number of wrap turns per meter of core bundles is from about 60 to about 200 for a 8000 dtex core bundle.

23. The wrapped cord according to claim 21 wherein the number of wrap turns per meter of core bundle is from 70 to 150 in S direction for 8000 dtex core bundle.

24. A wrapped cord comprising a core bundle of inorganic filaments and a wrap material having a free shrinkage in hot air of from 10% to 60% wrapped around said core bundle and shrunk by exposing the wrapped cord to an elevated temperature to form indentations in the core bundle.

25. The wrapped cord of claim 24 wherein the inorganic core filaments have a modulus of about 50 to about 1,000 MPa (ISO/FDIS 10618).

26. The wrapped cord of claim 24 wherein the inorganic core filaments have a tensile strength of about 1,000 to about 10,000 MPa (ISO/FDIS 10618).

27. The wrapped cord of claim 24 wherein the inorganic core filaments have a dtex of about 1.0 to about 50 dtex (ASTM D 885 M).

28. The wrapped cord of claim 24 wherein the core bundle of filaments comprises about 1000 to about 50,000 filaments.

29. The wrapped void of claim 24 wherein the inorganic core filaments are made of an inorganic material selected from carbon, glass and alumina.

30. The wrapped cord of claim 29 wherein the inorganic core filaments are made of carbon fibers.

31. The wrapped cord of claim 24 wherein the wrap comprises a single filament or a yarn of filaments.

32. The wrapped cord of claim 31 wherein the wrap dtex is from 3 to 40% of the dtex of the inorganic core yarn dtex.

33. The wrapped cord of claim 31 wherein the wrap filaments have a thermal free shrinkability of about 20 to about 60% in hot air at 100° C.

34. The wrapped cord of claim 31 wherein the material of the wrap is selected from aliphatic polyesters, aromatic polyesters, aliphatic polyamides.

35. The wrapped cord of claim 34 wherein the polyester is selected from the group consisting of polyethyleneterephthalate, polyethylenenaphthalate, polyethylenebibenzoate, polytriethyleneterephthalate, polytrimethylenenaphthalate, polytrimethylenebibenzoate, polybutyleneterephthalate, polybutylenenaphthalate and polybutylene-bibenzoate or polyesters made from mixtures of the individual monomers.

36. The wrapped cord of claim 34 wherein the polyamide is selected from the group consisting of PA 6, PA 6.6 and PA 4.6.

37. The wrapped cord of claim 24 wherein the filaments of the wrap have the following further properties:

a modulus of about 20 to about 150 cn/dtex (ASTM D 885 M) and a tenacity of about 2.0 to about 12.0 cN/dtex (ASTM D 885 M).

38. The wrapped cord of claim 24 wherein the wrap is helically twisted around the core bundle of inorganic filaments.

39. The wrapped cord according to claim 24 wherein the core bundle comprises inorganic filaments and a wrap is helically wound around the bundle of inorganic filaments.

40. The wrapped cord according to claim 24 wherein the core bundle comprises inorganic filaments and a wrap is helically wound around the bundle of inorganic filaments wherein the number of wrap turns per meter of core bundle is from about 50 to 250 for an 8000 dtex core bundle.

41. The wrapped cord according to claim 24 wherein the number of wrap times per meter of core bundle is from about 60 to about 200 for an 8000 dtex core bundle.

42. The wrapped cord according to claim 24 wherein the number of wrap turns per meter of core bundle is form 70 to 150 in S direction for an 8000 dtex core bundle.

* * * * *